United States Patent [19]

Simmons

[11] Patent Number: 4,820,135

[45] Date of Patent: Apr. 11, 1989

[54] FLUID DRIVEN PUMPING APPARATUS

[75] Inventor: Peter E. Simmons, London, England

[73] Assignee: Shell Oil Company, Houston, Tex.

[21] Appl. No.: 12,919

[22] Filed: Feb. 9, 1987

[30] Foreign Application Priority Data

Feb. 28, 1986 [GB] United Kingdom ..... 8605033

[51] Int. Cl.[4] ..... F04B 9/10

[52] U.S. Cl. ..... 417/391; 417/406; 417/408

[58] Field of Search ..... 417/391, 405, 406, 408; 418/9, 201, 202, 203, 197

[56] References Cited

U.S. PATENT DOCUMENTS

| | | | |
|---|---|---|---|
| 269,167 | 12/1882 | Baxter | 417/351 |
| 631,691 | 8/1899 | Blot . | |
| 1,693,102 | 11/1928 | Worthington | 417/408 |
| 1,702,838 | 2/1929 | Oliphant | 417/91 |
| 2,080,622 | 5/1937 | McMahon . | |
| 2,100,560 | 11/1937 | Kennedy | 417/406 X |
| 2,102,140 | 12/1937 | Ungar | 417/405 |
| 2,119,736 | 6/1938 | Coberly . | |
| 2,269,189 | 1/1942 | Downs . | |
| 2,804,260 | 8/1957 | Nilsson et al. . | |
| 2,910,948 | 11/1959 | Betzen | 417/338 |
| 3,184,155 | 5/1965 | Crooks | 417/338 |
| 3,282,495 | 11/1966 | Walls . | |
| 3,347,169 | 9/1966 | Cronin et al. . | |
| 3,693,601 | 9/1972 | Savder | 418/9 X |
| 3,802,803 | 4/1974 | Bogdanov et al. | 417/211.5 |
| 4,003,678 | 1/1977 | David | 417/88 |
| 4,086,030 | 4/1978 | David | 417/88 |
| 4,237,976 | 12/1980 | Wilson | 166/297 |
| 4,292,011 | 9/1981 | Erickson | 417/391 |
| 4,386,654 | 6/1983 | Becker | 166/105.5 |
| 4,514,090 | 4/1985 | Neubauer et al. | 366/91 |
| 4,614,232 | 9/1986 | Jurgens et al. | 166/105.5 |

OTHER PUBLICATIONS

"History of Petroleum Engineering", American Petroleum Institute, 6/1961, p. 700.

*Primary Examiner*—Leonard E. Smith

[57] ABSTRACT

A fluid driven pumping apparatus comprises a housing containing a twin rotor screw type positive displacement motor and a twin rotor screw type positive displacement pump. The screw rotors of said pump and motor are mounted on a pair of common shafts.

24 Claims, 1 Drawing Sheet

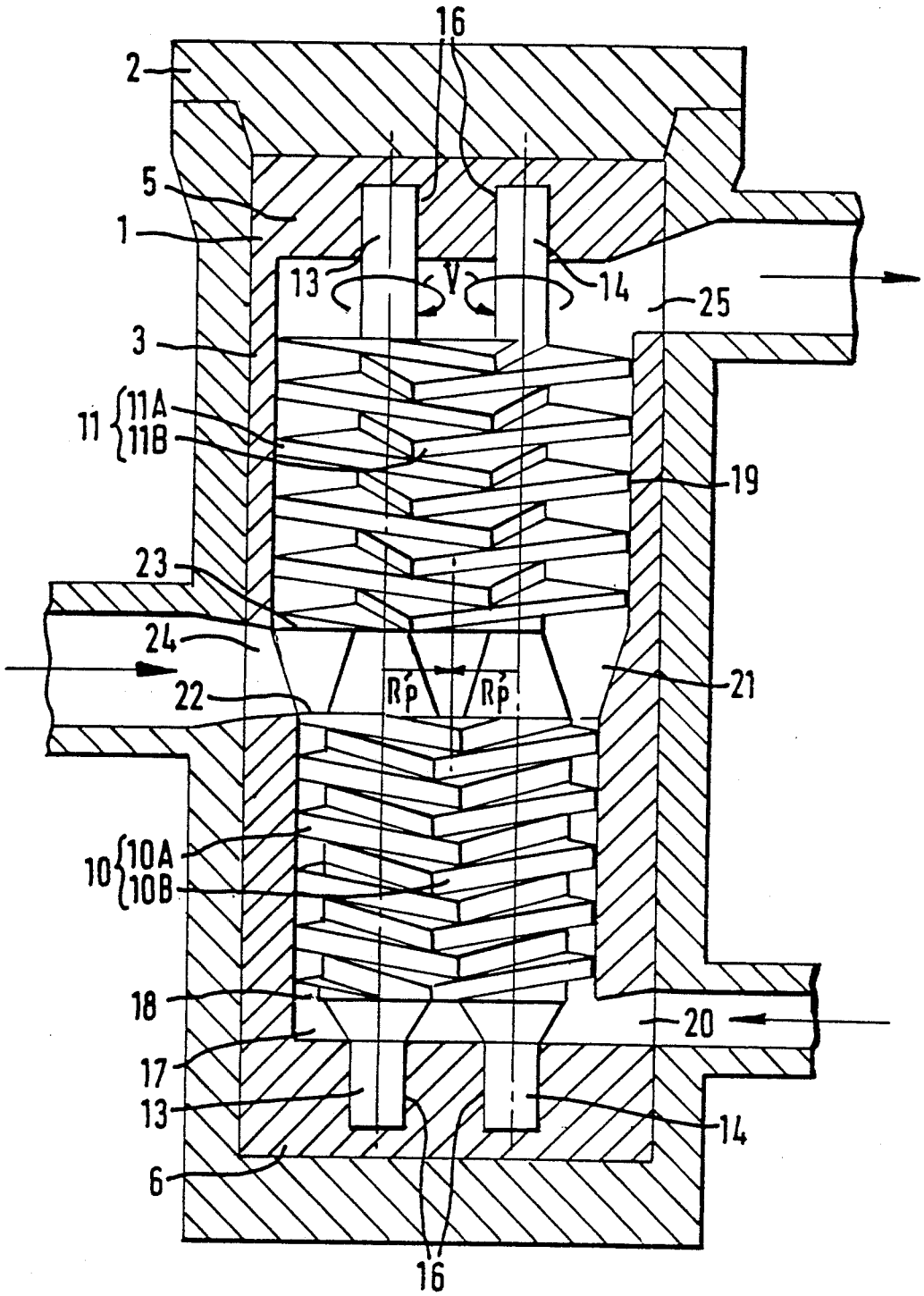
16
2
5
1
13
V
14
25
3
11
11A
11B
19
23
24
22
Rp
Rp
21
10
10A
10B
18
20
17
13
14
6
16

FLUID DRIVEN PUMPING APPARATUS

BACKGROUND OF THE INVENTION

The invention relates to a fluid driven apparatus for pumping a fluid or a mixture of fluids. The invention relates in particular to a fluid driven apparatus for pumping fluids at remote or difficult accessible locations, such as in a well or in a subsea flowline.

Apart from jet pumps, which are rather inefficient, presently available fluid driven pumps are generally of the turbine type. However, turbine pumps employ high fluid velocities and narrow fluid passages which gives rise to a high wear rate and thus to frequent maintenance if the produced fluid is sand bearing.

SUMMARY OF THE INVENTION

An object of the invention is to provide a compact and reliable fluid driven pumping apparatus which has a low wear rate even if the produced fluid is sand bearing and which can be easily installed in a flowline system.

A further object of the invention is to provide a fluid driven pumping apparatus which is able to pump both gaseous and liquid fluids or mixtures thereof.

The pumping apparatus according to the invention thereto comprises a twin rotor screw type positive displacement motor having a driving fluid inlet and a driving fluid outlet and connected to said motor a twin rotor screw type positive displacement pump having a pumped fluid inlet and a pumped fluid outlet. The apparatus further comprises a pair of shafts rotatably mounted in a housing, each shaft carrying a screw rotor of said pump and a screw rotor of said motor.

In a preferred embodiment of the invention the driving fluid outlet is in fluid communication with the pumped fluid inlet so that the driving fluid emerging from the motor mixes with the incoming pumped fluid before the combined fluid stream passes into the pump.

In a suitable embodiment of the invention the screw rotors of said pump and motor which are mounted on a common shaft are identical in helix angle and pitch diameter. However, the screw rotors of said pump preferably have a larger tip diameter and a correspondingly smaller base diameter than the screw rotors of said motor.

BRIEF DESCRIPTION OF THE DRAWING

The invention may be carried into practice in a number of ways but one specific embodiment will now be described by way of example with reference to the accompanying drawing, in which:

FIG. 1 illustrates a longitudinal section of a pumping apparatus according to the invention.

DETAILED DESCRIPTION OF THE PREFERRED EMBODIMENTS

The pumping apparatus shown in the drawing, FIG. 1, comprises a housing 1 enclosed in a protective shell 2. The housing 1 consists of a side wall 3 and upper and lower terminal walls 5 and 6, respectively. The lower part of the housing contains a motor section consisting of a twin rotor screw type positive displacement motor 10, whereas the upper part of the housing contains a pump section consisting of a twin rotor screw type positive displacement pump 11. The motor section 109 comprises a pair of cooperating screw rotors 10A and 10B, and the pump section 11 comprises a similar pair of cooperating screw rotors 11A and 11B. The screw rotors 10A and 11A shown at the left side of the drawing are identical in helix angle and they are mounted on a common shaft 13, whereas the screw rotors 10B and 11B shown at the right side of the drawing are also identical in helix angle and mounted on a common shaft 14. The helix angles of the cooperating pairs of screw rotors 10A, 10B and 11A, 11B, respectively, are opposite to each other and the axes of rotation of the shafts 13 and 14 are parallel to each other.

As illustrated in the drawing the screw rotors 11A, 11B of the pump and the screw rotors 10A, 10B of the motor have identical pitch radii $R_p$, but the screw rotors 11A, 11B of the pump have a larger tip radius and a correspondingly smaller base radius than the screw rotors 10A, 10B of the motor.

The shafts 13 and 14 are supported by bearings 16 in the upper and lower terminal walls 5, 6.

The bearings 16 may be of any suitable type and it is preferred to lubricate the bearings with clean drive fluid derived from an inlet compartment 17 at the upstream end of lower compartment 18 of the motor. In order to facilitate lubrication of the bearings 16 in the upper terminal wall 5 the shafts 13 and 14 may each be provided with a bore (not shown) forming a fluid communication between the said inlet compartment 17 and the bearings 16 in said upper wall 5.

Furthermore, by means of radial drillings (not shown) in the screw rotors 11A, 11B, communicating with the bores, clean drive fluid can be introduced into close clearance points at the rotor tips, further preventing damage by sand and other erosive matter. Alternatively, clean drive fluid can be supplied to the bearings 16 in the upper terminal wall 5 through a suitable passage (not shown) in the housing.

During operation of the pumping apparatus, driving fluid is injected into the inlet compartment 17 via a driving fluid inlet port 20 passing through the side wall 3 of the apparatus 1 at a location adjacent to the lower housing wall 6. Said injection causes the drive fluid to move in upward direction through the lower compartment 18 towards a chamber 21 formed in the middle of the housing 1 between the downstream end 22 of the motor 10 and the upstream end 23 of the pump, thereby actuating the screw rotors 10A, 10B of the motor to rotate in opposite directions, as indicated by arrows V. The manner in which the drive fluid actuates the screw rotors 10A, 10B of the twin rotor screw type motor is known per se and does not require a detailed description.

Said rotation of the screw rotors 10A, 10B of the motor 10 induces the shafts 13, 14 and thus the screw rotors 11A, 11B of the pump 11 to rotate at the same speed in the direction of arrows V. Due to the large tip diameter and small base diameter of the pump rotors 11A, 11B in comparison to the motor rotors 10A, 10B, or in other words due to the large displacement volume of the pump 11 in comparison to that of the motor 10, the pump rotors 11A, 11B tend to suck more fluid away from the chamber 21 than the amount of driving fluid discharged from the motor 10.

This causes pumped fluid to be sucked into the chamber via a production fluid inlet 24 formed in the side wall 3 of the housing and to be subsequently pumped together with the driving fluid in upward direction by the pump rotors 11A, 11B towards a pumped fluid outlet 25 formed near the upper terminal wall 5.

The pumping apparatus according to the invention may be used to pump single- or multiphase fluids such as mixtures of hydrocarbon fluids containing crude oil and natural gas, while the pumped fluids may contain solid particles, such as sand, without giving rise to a largely increased wear rate of the apparatus. If the pumped fluid mainly consists of a liquid, it is preferred to use recirculated pumped fluid as driving fluid and to filter solid particles such as sand from the pumped fluid before reinjecting it into the driving fluid inlet 20 of the apparatus as a clean driving fluid. The reinjected pumped fluid may be mixed up with other fluids or lubricants if the viscosity of the pumped fluid is too high to allow it to be used as driving fluid.

If the pumped fluid consists of a gas-liquid mixture it is preferred to separate the liquid phase from the gaseous phase and to use the liquid phase as driving fluid. If the pumped fluid mainly consists of a gas it is preferred to use a liquid as driving fluid. This would enable sufficient lubrication of the bearings 16 and rotor tips 19 and would further provide sufficient minimum flow of liquid through the pump to enable the pump to continue to develop its full differential pressure.

It will be appreciated by those skilled in the art that instead of arranging the shafts parallel to each other, the shafts may also be arranged at an angle relative to each other, provided that the screw rotors of the pump and motor have a suitable shape.

Other modifications, changes and substitutions are intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A fluid driven pumping apparatus comprising:

a twin rotor screw type positive displacement motor comprising:

a driving fluid inlet;

a driving fluid outlet; and a pair of motor screw rotors;

a twin rotor screw type positive displacement pump having a greater fluid displacement volume than said motor, said pump comprising:

a pumped fluid inlet in fluid communication with the driving fluid outlet;

a pumped fluid outlet; and a pair of pump screw rotors, each having a larger tip diameter and correspondingly smaller base diameter than the motor screw rotors;

an elongated housing having the driving fluid inlet substantially at one end and the pumped fluid outlet substantially at the other end and providing a chamber between said motor and said pump in the interior of the housing which forms the driving fluid outlet and at which a port opening in the housing provides fluid communication with the chamber as the pumped fluid inlet; and a pair of parallel shafts rotatably mounted in the housing, each shaft carrying one of the pump screw rotors and one of the motor screw rotors having identical pitch diameter and helix angle.

2. A fluid driven pumping apparatus comprising:

a twin rotor screw type positive displacement motor comprising:

a driving fluid inlet;

a driving fluid outlet; and a pair of motor screw rotors;

a twin rotor screw type positive displacement pump having a greater fluid displacement volume than said motor, said pump comprising:

a pump fluid inlet in fluid communication with the driving fluid outlet;

a pumped fluid outlet; and a pair of pump screw rotors, each having a larger tip diameter and correspondingly smaller base diameter than the motor screw rotors;

an elongated housing having the driving fluid inlet substantially at one end and the pumped fluid outlet substantially at the other end and providing a chamber between said motor and said pump in the interior of the housing which forms the driving fluid outlet and at which a port opening in the housing provides fluid communication with the chamber at the pumped fluid inlet; and a pair of parallel shafts rotatably mounted in the housing, each shaft carrying one of the pump screw rotors and one of the motor screw rotors having identical pitch diamater.

3. A fluid driven pumping apparatus comprising a twin rotor screw type positive displacement motor having a driving fluid inlet and a driving fluid outlet, and connected to said motor a twin rotor screw type positive displacement pump having a pumped fluid inlet in communication with the driving fluid outlet and having a pumped fluid outlet, the fluid displacement volume of said pump being larger than the fluid displacement volume of said motor, the apparatus further comprising a pair of shafts rotatably mounted in a housing, each shaft carrying a screw rotor of said pump and a screw rotor of said motor.

4. The apparatus of claim 3, wherein said shafts are parallel to each other and the screw rotors of said pump and motor which are mounted on a common shaft are identical in pitch diameter and helix angle.

5. The apparatus of claim 1, wherein the screw rotors of said pump have a larger tip diameter and a correspondingly smaller base diameter than the screw rotors of said motor.

6. The apparatus of claim 3, wherein the driving fluid outlet consists of a chamber formed in the interior of the housing between said motor and said pump.

7. The apparatus of claim 6, wherein the pumped fluid inlet consists of a port opening formed in the housing wall, which port opening discharges into said chamber.

8. The apparatus of claim 3, wherein the driving fluid inlet is located near one end of the housing and the pumped fluid outlet is located near an opposite end of the housing.

9. A fluid driven pumping apparatus comprising:

a twin rotor screw type positive displacement motor comprising:

a driving fluid inlet;

a driving fluid outlet; and a pair of motor screw rotors;

a twin rotor screw type positive displacement pump having a greater fluid displacement volume than the motor, said pump comprising:

a pumped fluid inlet in communication with the driving fluid outlet;

a pumped fluid outlet; and a pair of pump screw rotors;

a housing; and a pair of shafts rotatably mounted in the housing, each shaft carrying one of the pump screw rotors and one of the motor screw rotors.

10. A fluid driven pumping apparatus in accordance with claim 9, wherein the housing is elongated and the driving fluid inlet is located near one end of the housing and the pumped fluid outlet is located near the opposite end of the housing.

11. A fluid driven pumping apparatus in accordance with claim 9, wherein said shafts are parallel to each other and the screw rotors of said pump and motor which are mounted on a common shaft are identical in pitch diameter and helix angle.

12. A fluid driven pumping apparatus in accordance with claim 11, wherein the pump screw rotors have a larger tip diameter and a correspondingly smaller base diameter than the motor screw rotors.

13. A fluid driven pumping apparatus in accordance with claim 9, wherein the driving fluid outlet consists of a chamber formed in the interior of the housing between said motor and said pump.

14. A fluid driven pumping apparatus in accordance with claim 13, wherein the pumped fluid inlet consists of a port opening formed in a wall of the housing, which port opening discharges into said chamber.

15. A fluid driven pumping apparatus comprising a twin rotor screw type positive displacement motor having a driving fluid inlet and a driving fluid outlet, and connected to said motor a twin rotor screw type positive displacement pump having a pumped fluid inlet, a pumped fluid outlet and a greater fluid displacement volume than said motor, the apparatus further comprising a pair of shafts rotatably mounted parallel to each other in a housing, each shaft carrying a screw rotor of said pump and a screw rotor of said motor, the screw rotors of said pump and motor which are mounted on a common shaft having identical pitch diameter and helix angle and the screw rotors of said pump having a larger tip diameter and a correspondingly smaller base diameter than the screw rotors of said motor.

16. The apparatus of claim 15 in which the driving fluid outlet of said motor is in fluid communication with the inlet of said pump.

17. The apparatus of claim 15, wherein the driving fluid outlet consists of a chamber formed in the interior of the housing between said motor and said pump.

18. The apparatus of claim 17, wherein the pumped fluid inlet consists of a port opening formed in the housing wall, which port opening discharges into said chamber.

19. The apparatus of claim 15, wherein the driving fluid inlet is located near one end of the housing and the pumped fluid outlet is located near an opposite end of the housing.

20. A fluid driven pumping apparatus comprising:

a twin rotor screw type positive displacement motor comprising:
- a driving fluid inlet;
- a driving fluid outlet; and
- a pair of motor screw rotors;

a twin rotor screw type positive displacement pump, said pump having a greater fluid displacement than the motor and comprising:
- a pumped fluid inlet;
- a pumped fluid outlet; and
- a pair of pump screw rotors;

a housing; and a pair of shafts rotatably mounted in the housing, each shaft carrying one of the pump screw rotors and one of the motor screw rotors, said shafts being parallel to each other and the screw rotors of said pump and motor which are mounted on a common shaft being identical in pitch diameter and helix angle and wherein the pump screw rotors have a larger tip diameter and a correspondingly smaller base diameter than the motor screw rotors.

21. A fluid driven pumping apparatus in accordance with claim 20 in which the driving fluid outlet of said motor is in fluid communication with the pumped fluid inlet of said pump.

22. A fluid driven pumping apparatus in accordance with claim 20, wherein the driving fluid outlet consists of a chamber formed in the interior of the housing between said motor and said pump.

23. A fluid driven pumping apparatus in accordance with claim 22, wherein the pumped fluid inlet consists of a port opening formed in a wall of the housing, which port opening discharges into said chamber.

24. A fluid driven pumping apparatus in accordance with claim 20, wherein the housing is elongated and the driving fluid inlet is located near one end of the housing and the pumped fluid outlet is located near the opposite end of the housing.

* * * * *